US010280625B2

(12) United States Patent
Byszenski et al.

(10) Patent No.: US 10,280,625 B2
(45) Date of Patent: May 7, 2019

(54) UNIT FOR COVERING AND UNCOVERING A SURFACE USING SELF-PROPELLED ADJUSTABLE SLATS

(71) Applicant: BIOSSUN, Sassenage (FR)

(72) Inventors: Alexandre Byszenski, Montluel (FR); Frédéric Foretti, Velleron (FR)

(73) Assignee: BIOSSUN, Sassenage (FR)

( * ) Notice: Subject to any disclaimer, the term of this patent is extended or adjusted under 35 U.S.C. 154(b) by 79 days.

(21) Appl. No.: 15/519,184

(22) PCT Filed: Oct. 14, 2015

(86) PCT No.: PCT/FR2015/052766

§ 371 (c)(1),
(2) Date: Apr. 14, 2017

(87) PCT Pub. No.: WO2016/059344

PCT Pub. Date: Apr. 21, 2016

(65) Prior Publication Data

US 2017/0226746 A1 Aug. 10, 2017

(30) Foreign Application Priority Data

Oct. 15, 2014 (FR) ..... 14 59896

(51) Int. Cl.
*E04F 10/10* (2006.01)
*E04B 7/16* (2006.01)
(Continued)

(52) U.S. Cl.
CPC ..... *E04F 10/10* (2013.01); *E04B 7/163* (2013.01); *E04B 7/166* (2013.01); *E05F 15/619* (2015.01);
(Continued)

(58) Field of Classification Search
CPC ..... E04F 10/10; E04B 7/163; E04B 7/084; E04B 7/166; E06B 7/084
See application file for complete search history.

(56) References Cited

U.S. PATENT DOCUMENTS 4,128,307 A * 12/1978 Badertscher ..... A01G 9/222 359/596
4,449,563 A * 5/1984 Toda ..... E06B 9/26 160/184
(Continued)

FOREIGN PATENT DOCUMENTS

EP 1 262 624 12/2002
WO 2012/107350 8/2012

*Primary Examiner* — Justin B Rephann
(74) *Attorney, Agent, or Firm* — Clark & Brody

(57) ABSTRACT

The invention relates to a unit for covering and uncovering a surface using adjustable slats (3), comprising:

for each slat (3), a set of two carriages ($\mathbf{10_1}$, $\mathbf{10_2}$) guided in translation along guide tracks (8);

a system (II) for moving the slats (3), comprising two movement motors (12) for each carriage pair ($\mathbf{10_1}$, $\mathbf{10_2}$) equipping a slat, each motor being mounted in a different carriage;

a system (I) for orientating the slats (3), comprising at least one orientation motor (14) for each carriage pair equipping a slat, said at least one motor being mounted in at least one of the carriages;

and a control device for moving at least part of the slats in translation and orientating said slats.

14 Claims, 5 Drawing Sheets

(51) Int. Cl.
*E06B 7/084* (2006.01)
*E05F 15/619* (2015.01)

(52) U.S. Cl.
CPC ..... *E06B 7/084* (2013.01); *E05Y 2900/146* (2013.01)

(56) References Cited

U.S. PATENT DOCUMENTS 4,527,355 A * 7/1985 Numakami ..... E04F 10/10 49/275
5,732,507 A * 3/1998 Edwards ..... E04B 7/163 49/74.1
5,873,202 A * 2/1999 Parks ..... E04B 7/163 49/74.1
6,202,363 B1 * 3/2001 Chang ..... E04B 7/163 160/22
8,528,621 B2 * 9/2013 Murphy, Jr. ..... E04F 10/10 160/5
8,756,873 B1 * 6/2014 Hire ..... E04F 10/10 49/74.1
9,222,264 B1 * 12/2015 Reid ..... E04F 10/10
2013/0056159 A1 * 3/2013 Gray ..... E04F 10/10 160/40
2013/0118082 A1 * 5/2013 Colson ..... E06B 7/096 49/82.1
2013/0248124 A1 9/2013 Barbulescu
2014/0175240 A1 * 6/2014 Selzer ..... E04B 7/163 248/237
2015/0376901 A1 * 12/2015 Partridge ..... E04B 7/163 52/1
2016/0032642 A1 * 2/2016 Rotchell ..... E06B 7/086 49/82.1
2016/0177575 A1 * 6/2016 Ivic ..... E04F 10/10 52/302.1
2018/0106046 A1 * 4/2018 Castel ..... E04F 10/02

* cited by examiner

UNIT FOR COVERING AND UNCOVERING A SURFACE USING SELF-PROPELLED ADJUSTABLE SLATS

The present invention relates to the technical field of units for covering and uncovering a surface using adjustable slats extending mutually parallel in order to form a screen for protecting or closing a surface in the general sense, these adjustable slats having the ability in the deployed position in relation to the surface, to be opened or closed, particularly according to weather conditions.

The subject of the invention addresses many applications, in particular for forming a covering of a roof forming part of a pergola or terrace for example, or a protective screen for doors or windows.

In the prior art, there is known, for example through document AU 7 190 396, the production of a roof from a succession of adjustable slats extending mutually parallel along their longitudinal edges. The adjustable slats are controlled to pivot together using a motor driving system to occupy either a closed position wherein the slats are contiguous by their longitudinal edges or an open position wherein the slats are not contiguous to allow the air and rays of sunlight to pass.

By comparison with a fixed roof, which can only be used to protect a space from rain and sun, this opening roof also offers the possibility of controlling, at will, the ventilation and entry of sunshine into the space equipped with such a roof. However, this opening roof has the drawback of allowing the adjustable slats to remain permanently above the surface to be covered, which can be a drawback, particularly during a long period with no sunshine.

To remedy this problem, in the field of closing shutters, by patent FR 1 475 733, a unit is known for covering and uncovering an opening, using adjustable slats extending mutually parallel while being equipped at each of their ends with a pivot pin. The unit comprises, on each side of the neighboring slat ends, a mechanism suitable for orientating the slats about their pivot pins and for moving the slats between a deployed position and a retracted position in a holder wherein the slats are side-by-side with one another.

Each adjusting and moving mechanism comprises firstly, a chain or an external belt mounted endlessly between fixed idler pulleys and having an external strand and an internal strand, and secondly, an internal belt mounted endlessly between fixed idler pulleys and having an external strand and an internal strand that extends vis-à-vis the internal strand of the belt to delimit together a drive passage for the slats. Each orientating and moving mechanism comprises a system for synchronized motor driving of external belts and a system for synchronized motor driving of internal belts. The motor driving of the motor drive systems is controlled to firstly, move the internal strands in the same direction to move the slats in the drive channel in translation, and, secondly, move the internal strands in the reverse direction to orientate the slats.

Each orientating and moving mechanism comprises a device for distributing the slats driven by the systems for synchronized motor driving of the belts and suitable for, along one direction of movement of the strands, successively engaging the slats in the drive channel, obeying a constant increment of separation, and in an opposite direction of movement, successively disengaging the slats from the drive channel so that they are occupying their retracted position.

This unit is not designed to form a roof and in practice turns out to be unsuitable for covering a relatively large opening. Another drawback of such a unit relates to the need for providing a holder for storing the slats. This storage holder is laid out either to encroach on the surface to be covered or is an extension of the surface to be covered if a location is available for this purpose.

The patent EP 1 595 053 describes a mechanism for closing an opening based on slats each equipped, at each of their ends, with a nut co-operating with a motor-driven screw extending along the whole length of the opening. The nuts are engaged in a guide rail for providing the translation of the slats when the screws are rotated. This mechanism also comprises, in a holder for storing the slats in the folded position, a rack engaging with the nuts in order to distribute the slats according to a constant increment or to stack them in the holder. Moreover, each end of the slats is provided with a roller engaging with a system for orientating the slats.

A drawback of this solution is the presence of a storage holder wherein the slats cannot be orientated. In addition, this solution is complex and expensive to produce due to the use of screws of considerable length and the precision required in particular for the change from guiding by slider to guiding by rack. This solution turns out to be unachievable in practice for shuttering a large opening.

Patent application WO 2012/107350 describes a thermal shutter unit for windows comprising a series of adjustable shutters extending mutually parallel, each being supported by a guide at each of its ends. The unit comprises, on either side of the shutters, threaded stems engaging with a gearbox equipping each shutter guide. The guides of each shutter are provided with motors to orientate the shutters and to move the shutters independently of one another.

This unit turns out to be complex and expensive to produce due to the use of threaded stems and due to the degree of precision required for its assembly. Such a unit is not suitable for covering a surface of large dimensions.

Patent application US 2013/248124 describes a system for controlling the position and orientation of a panel equipping a window in relation to the sun. In a variant embodiment, this panel is moved in translation using an electric motor built onto the panel and having an output pinion which engages with a rack supported by the window frame. Such a system is not suitable for covering a surface using slats that must be moved in translation and orientated in inclination.

The present invention aims to remedy the drawbacks of the prior art by proposing a unit of simple and cost-effective design for covering and uncovering, using adjustable slats, a surface either vertical or horizontal, which has variable dimensions within a wide range and which may be of large dimensions.

The aim of the present invention is to propose a fully modular unit making it possible to adapt easily to the dimensions of the surface to be covered, while offering the advantage of being able to orientate the slats of various areas of the surface in different positions as desired.

Another subject of the invention aims to propose a unit not requiring a dedicated space for storing the slats in the folded position.

To achieve such an aim, the unit for covering and uncovering a surface delimited by a bearing structure using adjustable slats comprises:

- a series of adjustable slats extending mutually parallel along their longitudinal edges and equipped at each of their end edges with a pivot pin;
- a system for orientating the slats suitable for pivoting at least some of the slats so that the longitudinal edges of the slats are contiguous or non-contiguous for respectively closing or opening the related surface;

a system for moving the slats between a retracted position wherein the slats are side-by-side and a deployed position wherein at least a part of the slats are deployed with regard to the surface;

two tracks for guiding the slats in translation, formed on the bearing structure while being arranged mutually parallel on two opposite sides of the surface.

According to the invention:

each slat is supported by its pivot pins using a set of two carriages guided in translation along the guide tracks;

the movement system comprises, for each carriage pair equipping a slat, two movement motors, one being mounted in the first carriage and the other in the second carriage and each rotationally driving a pinion for driving the pivot pin of the slat in translation, the pinion engaging with a rack assembled on the bearing structure along a direction parallel to the guide track;

the orientation system (I) comprises, for each carriage pair equipping a slat, at least one orientation motor (14) being mounted in at least one of the carriages and angularly linked with the pivot pin;

position and slat (3) movement sensors (50);

and a control device linked to the sensors (50), the movement motors (12) and the orientation motors (14), for moving at least part of the slats in translation and orientating said slats, In addition, the unit according to the invention can furthermore possess in combination at least one and/or the other of the following additional features:

the orientation system comprises for each slat an orientation motor being mounted in one of the carriages equipping said slat;

the carriages provided with a movement motor and an orientation motor on the one hand, and the carriages provided with a movement motor on the other hand, are assembled alternately from one slat to the next, along each side of the surface to be covered or uncovered;

each carriage equipped with a movement motor has a main support body for the movement motor, this main body being provided with a rotational guide system for the pivot pin of the slat, freely engaged in a housing formed in the slat, the pivot pin being provided with the pinion and rotationally driven by the movement motor;

each carriage equipped with a movement motor and an orientation motor comprises a main support body for the movement motor and the orientation motor, the main body being provided for a system for rotationally guiding a tubular shaft equipped with the pinion and rotationally driven by the movement motor, the pivot pin being assembled inside the tubular shaft while being rotationally driven by the orientation motor and assembled to rotate with the slat as a single part;

each carriage comprises a main body linked by a removable link pin, to a guide bearing engaging with a guide track;

each rack is formed by a toothed belt attached to the bearing structure;

the position and slat movement sensors comprise contact sensors assembled on the carriages of a guide track to be actuated by the carriage located ahead in the direction of extension of the slats or by the bearing structure for the carriage of the last slat in the direction of extension;

the position and slat movement sensors comprise sensors for measuring the rotation of the movement motors and the rotation of the orientation motors as well as sensors for detecting the direction of orientation of the slats;

the control device comprises a calibration mode and several preset use modes each corresponding to a type of slat position;

the control device controls the operation of the movement and orientation motors in such a way that prior to the control to move a slat, the control device controls the orientation motor of said slat to place it in the vertical position if it is not occupying this vertical position;

for a use mode consisting in the extension of a determined number of slats from their retracted position, the control device controls the operation of the movement motors of the slats to be deployed, in such a way that each time the first slat is advanced by one increment, the slat located ahead is controlled to move, the slat movement motors being controlled until the slats are occupying their extended position;

the control device controls the movement motors in such a way that the movement increment of the slats corresponds to the separation between two consecutive slats contiguous in the horizontal position;

the control device controls the operation of the orientation motors only if the slat occupies a fixed position different from the retracted position.

Various other features will become apparent from the description given below with reference to the appended drawings which show, by way of non-limiting example, embodiments of the subject of the invention.

Figure 1:
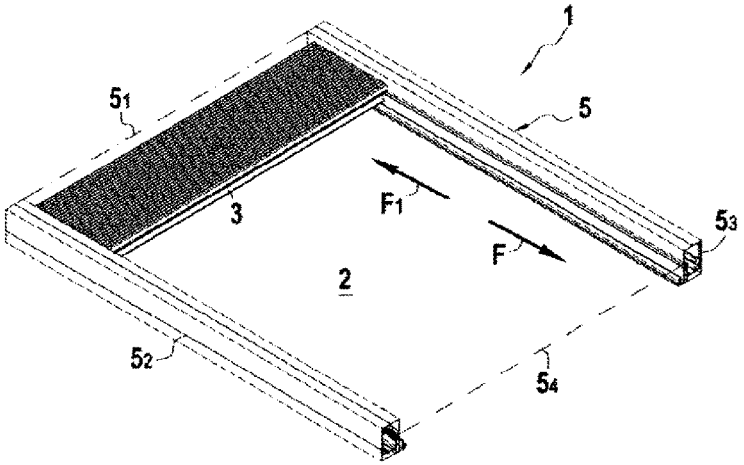
FIG. 1 is a perspective view of an exemplary embodiment of a unit according to the invention wherein the slats are all retracted in the upright position.
Figure 2:
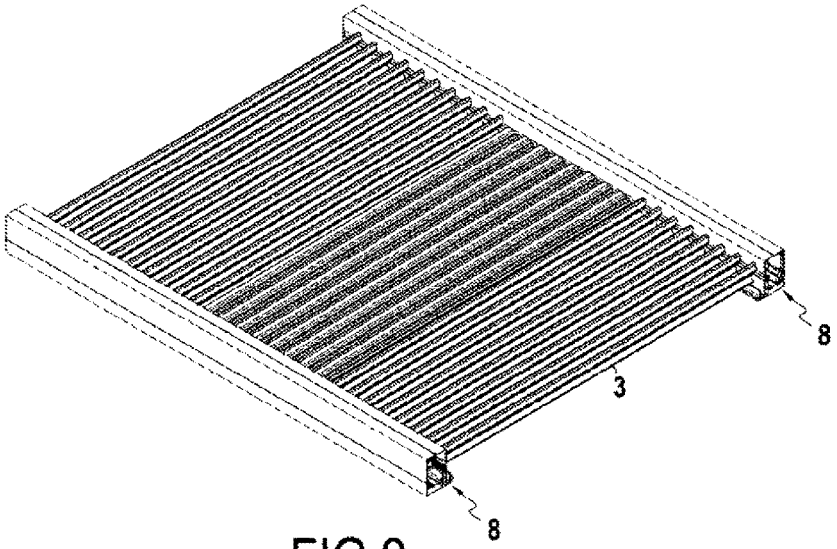
FIG. 2 is a perspective view of an exemplary embodiment of a unit according to the invention wherein the slats are all deployed with a part in the contiguous position.
Figure 3:
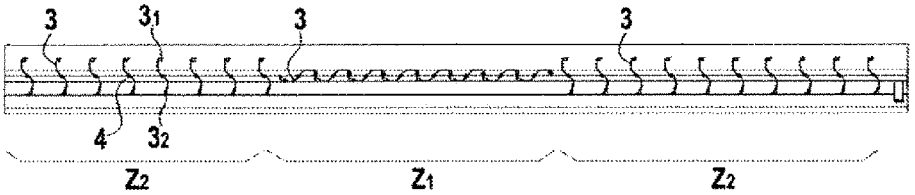
FIG. 3 is a section view of the unit illustrated in FIG. 2 and showing the position of pivot of the slats in the deployed position.

As can be seen in more detail in FIGS. 1, 2 and 3, the subject of the invention relates to a unit 1 for covering and uncovering a surface 2 by a series of adjustable slats 3 extending behind one another, preferably being all identical and mutually parallel along their longitudinal axis. Each adjustable slat 3 has a generally rectangular shape delimited by a first and a second longitudinal edge $\mathbf{3}_1$ and $\mathbf{3}_2$ parallel to one another and linked together by first and second end edges $\mathbf{3}_3$ and $\mathbf{3}_4$ also parallel to one another. Of course, the number and dimensions of the adjustable slats are adapted to the dimensions of the rectangular surface 2 to be covered. Preferably and as can be seen from the drawings, the adjustable slats 3 are capable of forming together a screen of rectangular shape delimited on one hand by the longitudinal edge $\mathbf{3}_1$ of the first slat 3 and by the longitudinal edge $\mathbf{3}_2$ of the last slat 3 and on the other hand, by the set of first end edges $\mathbf{3}_3$ of the slats aligned together and by the set of second end edges $\mathbf{3}_4$ of the slats aligned together.

The slats 3 are provided at each of their end edges, with a pivot pin 4 for allowing their orientation. The unit 1 comprises a mechanism I for orientating the slats 3 about their pivot pin 4 in order to ensure the pivoting of at least some, and in general of all the slats 3 so that the longitudinal edges $\mathbf{3}_1$, $\mathbf{3}_2$ of the adjacent slats are contiguous for closing the related surface or are non-contiguous for opening the surface 2.

As is apparent from FIGS. 2 and 3, the adjustable slats 3 can thus form in an area $Z_1$, a screen insofar as the longitudinal edges of the slats are contiguous with the longitudinal edges of the neighboring slats. In two adjacent areas $Z_2$, the slats 3 are deployed above the surface occupying an upright or open position. Of course, this example of deployment of the slats 3 is given for illustration purposes solely insofar as the slats 3 can be deployed and orientated in many other configurations, as will be better understood in the remainder of the description.

The unit according to the invention also comprises a system II for moving the slats 3 between a retracted position (FIG. 1) and a position partly or fully deployed with regard to the surface 2 (FIGS. 2 and 3). In the retracted position, the slats 3 are side-by-side between a retracted front slat and a retraction edge $\mathbf{5}_1$ of a bearing structure or frame 5. In this retracted position, the slats 3 cannot be orientated and the slats 3 are occupying an upright position, i.e. the slats are located in parallel planes substantially perpendicular to the surface 2, namely vertical in the example illustrated.

The systems I and II provide the movement and orientation of the slats 3 in such a way that they form together at least one protective screen opening and closing as desired. According to the intended applications, this screen forms a roof or protective shutter that can totally cover the surface 2 or only a part of the surface 2, with the option to orientate the slats as needed when the slats are not in the retracted position.

The unit 1 also comprises two guide tracks 8 providing the guiding in translation for the slats 3 between a retracted position wherein the slats are side-by-side (FIG. 1) and a deployed position wherein at least part or all of the slats 3 are deployed with regard to the surface 2 (FIGS. 2, 3).

The guide tracks 8 are arranged in the bearing structure of the frame 5 produced in any appropriate manner according to the intended applications and which surrounds the surface 2 to be covered to advantageously form a frame.

This bearing structure 5 advantageously comprises two longitudinal profiles $\mathbf{5}_2$ and $\mathbf{5}_3$ extending mutually parallel along two opposite sides of the surface 2 and parallel to the guide tracks 8. These two longitudinal profiles $\mathbf{5}_2$ and $\mathbf{5}_3$ are linked together at their ends, by connecting profiles $\mathbf{5}_1$ and $\mathbf{5}_4$ (not shown) together forming a frame delimiting the surface 2. One of the connecting profiles $\mathbf{5}_4$ delimits the abutment edge for the longitudinal edge $\mathbf{3}_1$ of the first slat whereas the other profile $\mathbf{5}_1$ delimits the retraction edge for the longitudinal edge of the last slat 3. The last slat and the first slat are taken into consideration of the direction of deployment of the slats represented by the arrow F for which the slats change from the retracted position to the deployed. When the slats 3 are folded along the direction $F_1$ opposite to the direction F, the first and last slats are considered to be the same as those designated during the deployment operation.

The unit 1 according to the invention is intended to be attached by any appropriate means to a bearing structure, not shown, adapted to the intended application. If the unit 1 according to the invention is intended to form the roof of a pergola for example, the bearing structure 5 comprises posts supporting the frame formed by the connecting profiles and the longitudinal profiles.

Figure 4:
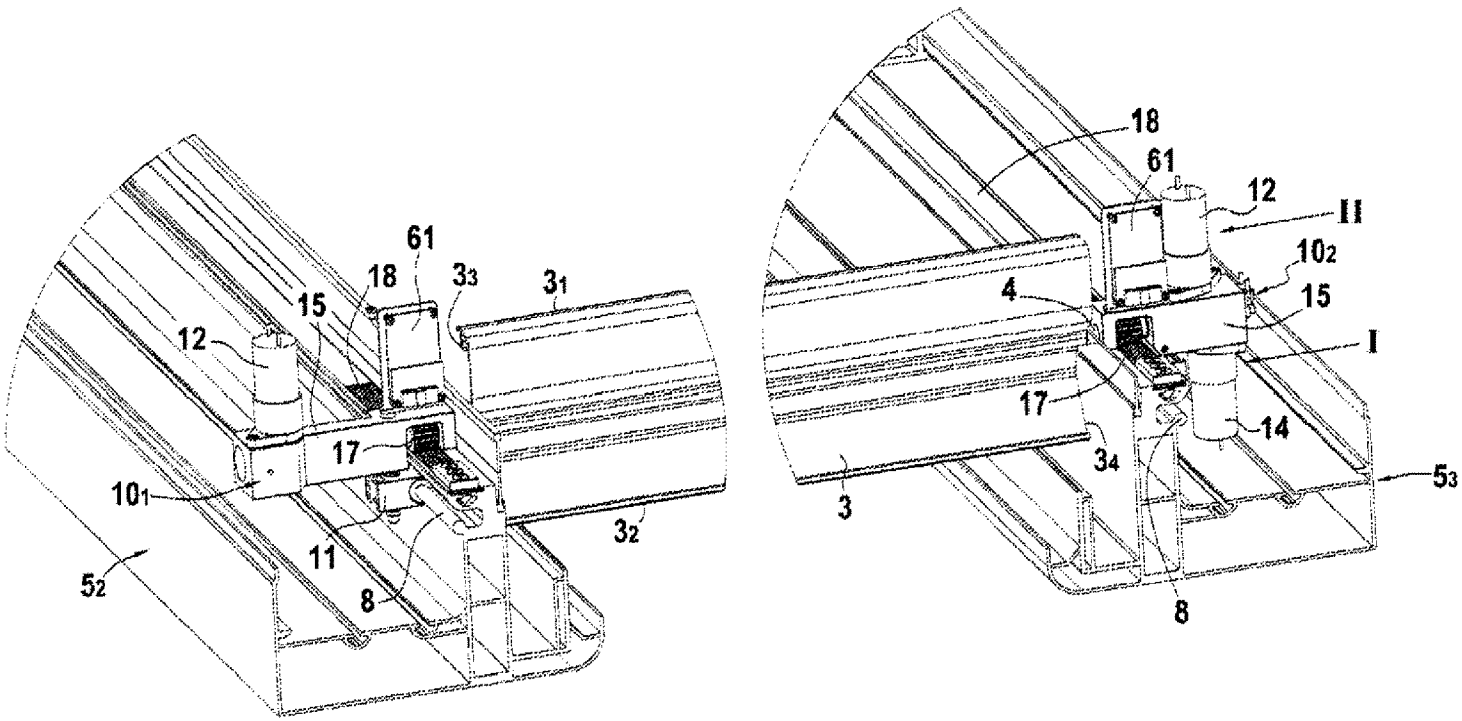
FIG. 4 is an exploded perspective view showing in more detail the assembly of a slat forming part of a unit according to the invention.

In accordance with the invention, each slat 3 is supported at each of its ends, more precisely by its pivot pins 4, by a set of two carriages $\mathbf{10}_1$, $\mathbf{10}_2$ guided in translation along the guide tracks 8. As can be seen in more detail in FIGS. 4 to 6, each slat 3 is therefore supported by its pivot pins 4, using two carriages $\mathbf{10}_1$, $\mathbf{10}_2$ moving in translation along the guide tracks between the retracted position and the deployed position. For this purpose, each carriage $\mathbf{10}_1$, $\mathbf{10}_2$ is equipped with a guide bearing 11 engaging with a guide track 8.

In accordance with the invention, the movement system II comprises for each carriage pair $\mathbf{10}_1$, $\mathbf{10}_2$ equipping a slat, advantageously two movement motors 12 each being mounted in a carriage. It should be understood that each slat 3 is driven by two motors to balance the forces applied to the slats 3. For example, the movement motors 12 are electrical motors, for example DC brushed motors, linked to a power source by way of connecting cables not shown.

It is apparent from the previous description that the slats 3 are self-propelled and can be moved independently from one another. According to a feature of the invention, each slat 3 can also be orientated individually. Thus, the orientation system I comprises for each carriage pair equipping a slat, at least one, and in the illustrated example only one orientation motor 14 being mounted in one of the two carriages $\mathbf{10}_1$ and $\mathbf{10}_2$ equipping a slat 3. Each orientation motor 14 is angularly linked to a pivot pin 4 to place the slat 3 in an upright determined angular position (perpendicular to the surface 2, namely vertical in the case of a pergola), closing position (in the horizontal position) or intermediate position caught between these two vertical and horizontal positions.

According to the preferred exemplary embodiment illustrated in the drawings, each slat 3 is therefore supported, at one of its ends, by a first carriage $\mathbf{10}_1$ carrying only a movement motor 12 and, at its opposite end, by a second carriage $\mathbf{10}_2$ carrying a movement motor 12 and an orientation motor 14. The carriages $\mathbf{10}_2$ equipped with a movement motor 12 and an orientation motor 14 on the one hand and the carriages $\mathbf{10}_1$ equipped with a movement motor 12 on the other hand are assembled alternately from one slat to the next along each side of the surface 2 to be covered or uncovered. In other words, the first and second carriages are assembled alternately along each longitudinal side of the bearing structure. Such an arrangement makes it possible to save space, particularly in the retracted position as will be explained in the remainder of the description.

Each carriage $\mathbf{10}_1$, $\mathbf{10}_2$ has a main body 15 of elongate parallelepipedal general shape extending mainly along the axis of pivot 4. Preferably, the bodies 15 of the first and second carriages are not identical, precisely to save space in the retracted position. As can be seen in more detail from FIGS. 4 and 7, the main body 15 of the second carriages $\mathbf{10}_2$ has a length, taken along the direction of extension of the slats 3, that is smaller than that of the main body of the first carriages $\mathbf{10}_1$. Specifically, the movement motor 12 is assembled at the end of the main body 15 of the first carriages $\mathbf{10}_1$, thus allowing this main body 15 to have a shortened shape to receive the main body of a second carriage $\mathbf{10}_2$. Thus, as is apparent from FIG. 7, the main bodies 15 of the first and second carriages are mutually interlocked in the retracted position.

Of course, each movement motor 12 is assembled in any appropriate way on the main body 15 of each carriage $\mathbf{10}_1$, $\mathbf{10}_2$. Each movement motor 12 rotationally drives a pinion 17 driving a slat 3 in translation. Each pinion 17 engages with a rack 18 assembled on the bearing structure 5 along a direction parallel to the guide track 8 and along the whole length of the guide track to allow the slates to translate between their retracted and deployed positions. In an advantageous variant embodiment, each rack 18 is provided by a toothed belt attached to the bearing structure 5.

In the exemplary embodiment illustrated in the drawings (FIG. 6), each rack 18 is assembled on the upper face of a median partition 5*a* presented by each longitudinal profile $5_2$, $5_3$. According to this example, each longitudinal profile $5_2$, $5_3$ has a core 5*b* extending horizontally and from which the median partition rises up 5*a* and on either side, an external wing 5*c* and an internal wing 5*d*. The median partition 5*a* is equipped with the guide track 8 produced under the external face receiving the rack 18. In the illustrated example, the guide track 8 is provided by a rail of circular profile extending partly in a housing arranged in the partition to allow the assembly of the guide bearing 11.

According to a feature of the invention, each longitudinal profile $5_2$, $5_3$ is produced by extrusion. The profiles can be assembled end-to-end as desired, to adapt to the dimensions of the surface 2 to be covered. Advantageously, the median partition 5*a* and the internal wing 5*d* delimit between them a gutter 5*e* in line with which the end edges of the slats extend, to collect any rain water.

The longitudinal profiles $5_2$, $5_3$ that are open can advantageously be closed using a cover 19 that protects the carriages and with the profiles assembled between the outer wing 5 and the media partition 5*a*. This cover 19 is provided with brushes $19_1$ (FIG. 5) for allowing the pivot pins 4 to pass through.

Advantageously, each guide bearing 11 is linked to the main body 15 of the carriages $10_1$, $10_2$ by way of a link pin 20, preferably of removable nature. As can be seen in more detail from FIG. 6, the link pin 20 extends substantially perpendicular to the rail 8. The link pin 20 is assembled to traverse the main body 15 and the bearing 11 by coming from one side, supported by a head 21 on the body 15 and being blocked in translation by a blocking component 22 such as a nut bearing against the inner face of the guide bearing.

Advantageously, a spring 23 is engaged on the link pin 20 and interposed between the main body 15 and the guide bearing 11 to offset the manufacturing and assembly tolerances.

Figure 5:
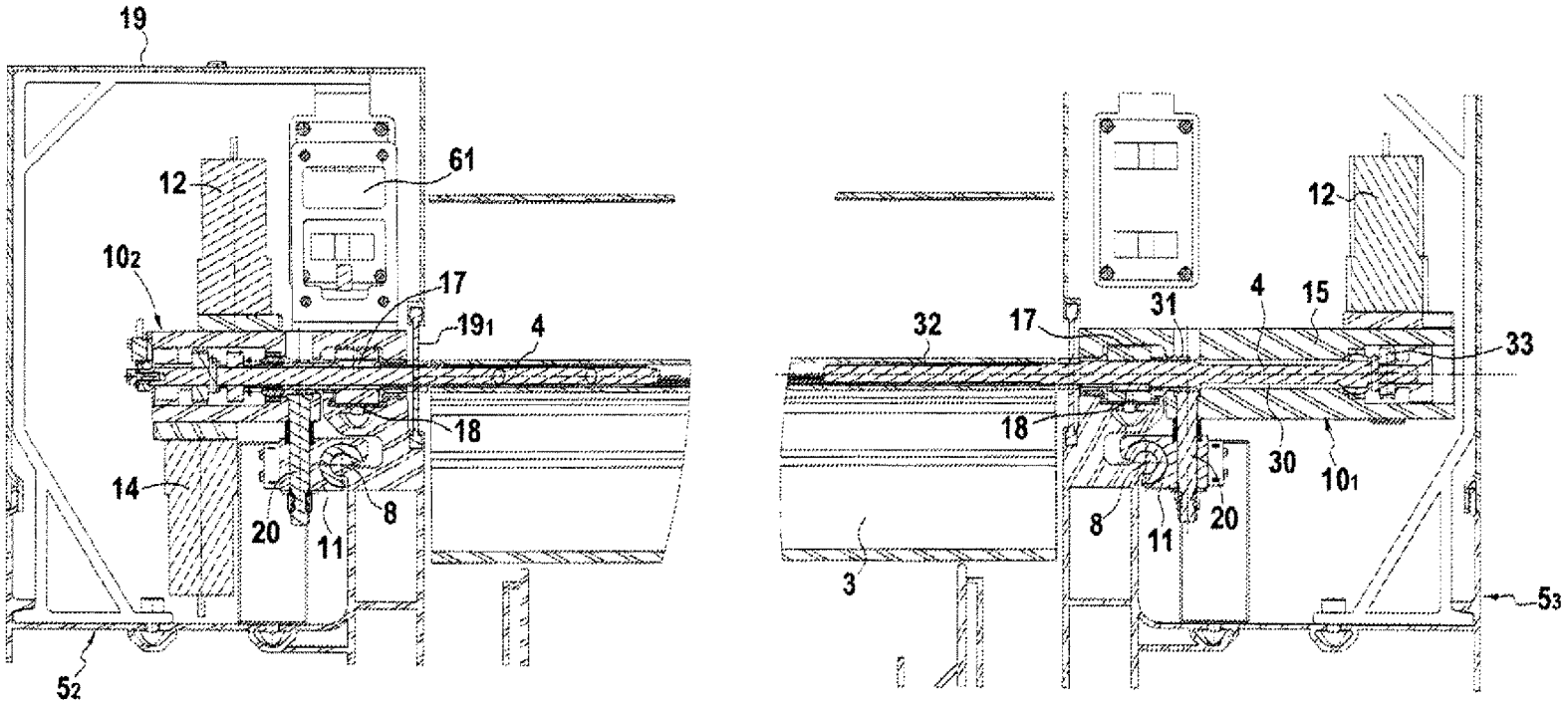
FIG. 5 is an elevation section view showing the assembly of a slat.

FIG. 5 is a more detailed illustration of an exemplary embodiment of the first carriages $10_1$ each containing solely one movement motor 12. Each first carriage $10_1$ comprises a central bore 30 equipped with a system 31 for rotationally guiding the pivot pin 4 of the slat. The pivot pin 4 is rotationally driven by the movement motor 12, the output shaft of which engages with a toothed wheel 33 angularly attached to the pivot pin 4. The pinion 17 is angularly attached to the pivot pin 4 and engages with the rack 18. The pivot pin 4 is engaged freely inside a housing 32 formed in the slat 3. The rotation of the movement motor 12 in one direction or the other direction makes it possible to move the carriage $10_1$ in translation along the guide track 8, by the pinion 17/rack 18 link. The translation of the carriage $10_1$ drives the movement of the related slat 3, because of the translational link between the pivot pin 4 and the slat 3 by the free engagement of the pivot pin 4 in the housing 32 of the slat. Each pinion 17 engages directly with a pivot pin 4 (since they form a single part) in such a way as to drive the pivot pin 4 of the slat 3 in translation, by the pivot link produced between the slat 3 and the pivot pin 4.

Figure 6:
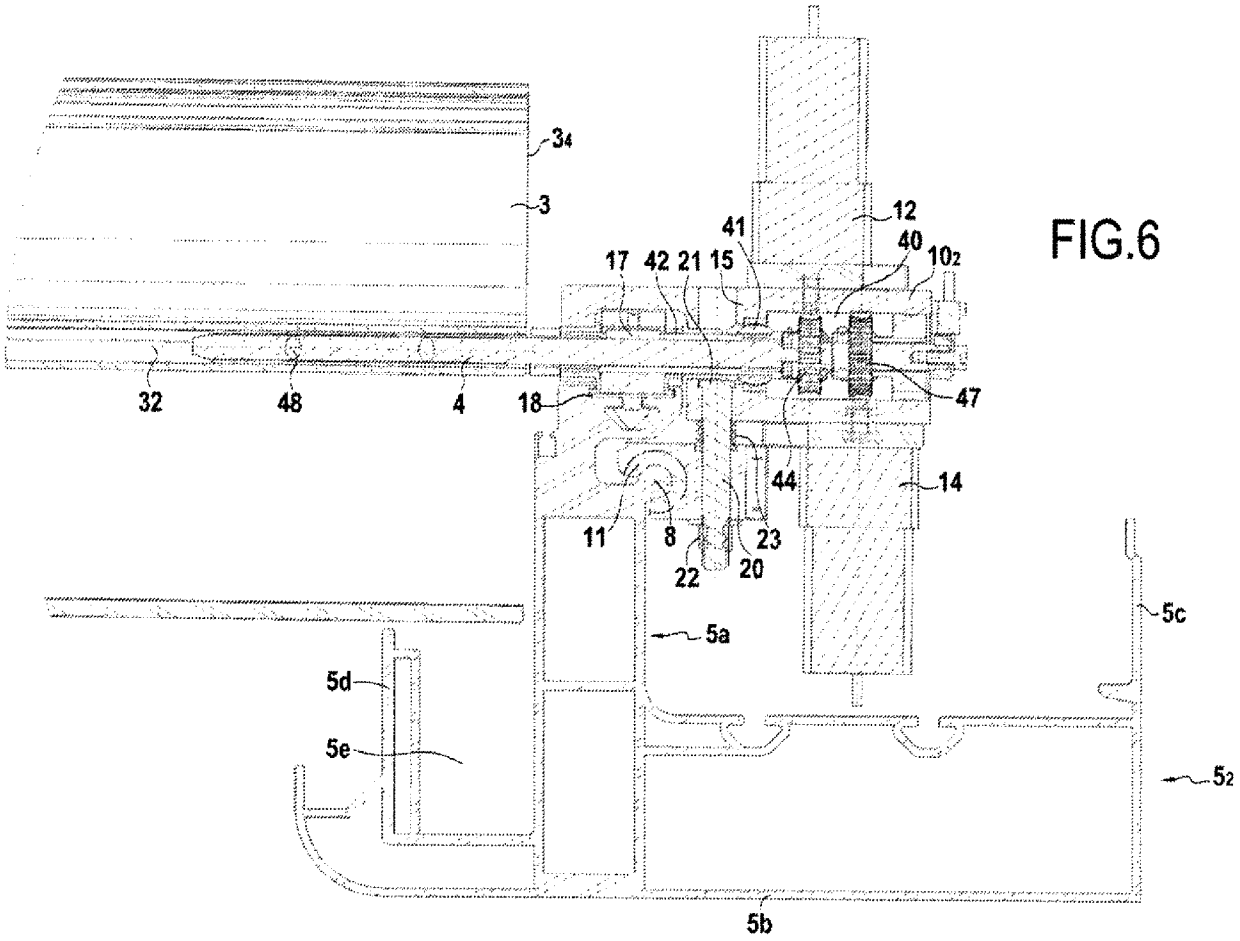
FIG. 6 is a large-scale view showing the embodiment of a carriage provided with a movement motor and an orientation motor.

FIGS. 5 and 6 are a more detailed illustration of an exemplary embodiment of the second carriages $10_2$ containing both a movement motor 12 and an orientation motor 14. Each second carriage $10_2$ comprises a bore 40 equipped with a rotational guide system 41 for a tubular shaft 42 inside which a pivot pin 4 is freely engaged. A pinion 17 engaging with the rack 18 is angularly linked to this tubular shaft 42 which is rotationally driven by a toothed wheel 44 attached to the tubular shaft 42 and gearing with the output shaft of the movement motor 12.

The rotation of the tubular shaft 42 leads to the translation of the carriage $10_2$ driving the translation of the slat, the pivot pin 4 of which is pushed when the carriage is translated. Each pinion 17 engages indirectly with a pivot pin 4 to drive the pivot pin 4 of the slat 3 in translation, by the pivot link produced between the tubular shaft 42 and the pivot pin 4.

Moreover, the pivot pin 4 is rotationally driven by the orientation motor 14, the output shaft of which engages with a toothed wheel 47 rotationally shimmed with the pivot pin 4, the opposite end of which is engaged inside the housing 32 and angularly linked to the slat, for example using linking cotter pins 48. The pivot pin 4 is thus assembled to rotate freely inside the tubular shaft 42 and can be oriented as desired in a stable position determined using the orientation motor 14.

The unit 1 also comprises position and slat 3 movement sensors 50. Such sensors 50 make it possible to know the position of each of the slats 3 at any time along their whole course on the guide track. Such movement position sensors 50 can be produced in any appropriate way.

Figure 7:
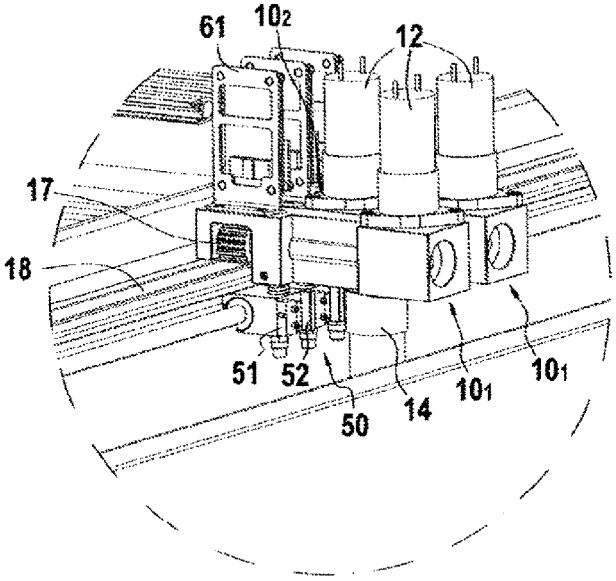
FIG. 7 is a partial perspective view showing three slats placed in the retracted position.

In the illustrated example and as can be seen in more detail from FIG. 7, the position and movement sensors 50 comprise contact sensors 51 each assembled on a carriage $10_1$, $10_2$ and able to be actuated by a limit stop 52 supported by the carriage located ahead in the direction of extension of the slats or by the bearing structure for the carriage of the last slat in the direction of extension. The contact sensors 51 make it possible to identify the position of the slats and in particular in their retracted position. The movement sensor 50 also comprises sensors (not shown) for measuring the rotation of the movement motors 12, such as encoders. These movement sensors make it possible to know the linear movement of the carriages $10_1$, $10_2$ over the whole length of their guide track 8.

Figure 8:
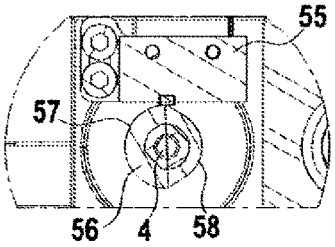
FIGS. 8 and 9 are views showing an exemplary embodiment of slat orientation position sensors.
Figure 9:
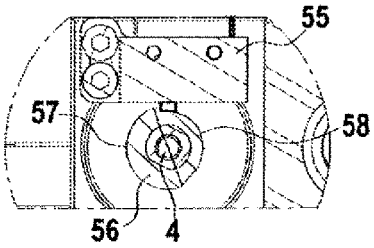

The position and movement sensors 50 also comprise sensors for measuring the rotation of the orientation motors 14 making it possible to know the angular orientation of the slats 3. The position and movement sensors 50 also comprise sensors 55 for detecting the direction of orientation of the slats. For example, these detection sensors 55 are produced by contact sensors as illustrated in FIGS. 8 and 9. For this purpose, each pivot pin 4 linked to an orientation motor 14 is provided with a cam 56 having two determined angular sectors 57, 58 one of which 57 acts on the contact of the sensors (FIG. 8) and the other of which 58 does not act on the contact (FIG. 9). The cam 56 is positioned in such a way as to detect the change from one sector 57 to the other 58 corresponding to a given position of the slats, upright for example. The direction of pivot can be identified by determining the direction of change from one sector to the other.

The unit 1 according to the invention also comprises a control device which is not shown, linked to the position and movement sensors 50, to the movement motors 12 and to the orientation motors 14 making it possible to move at least a part of the slats 3 in translation and to orientate said translated slats. Such a control device thus makes it possible to control the operation of the movement motors 12 and the orientation motors 14 in such a way as to make it possible to cover and uncover one or more areas of the surface 2 either as prompted or according to preset programs. The control device preferably comprises a control and power supply module remote from the unit and connected to electronic circuits 61 built into the carriages $\mathbf{10}_1$, $\mathbf{10}_2$. This control device preferably comprises a remote control for remotely controlling the unit in accordance with the invention.

Of course, the control device comprises a calibration mode allowing the unit to position the slats 3 in a definite position in order to identify their position. In general, the control system controls the motors 12, 14 before any first use in order to place the different slats 3 in the retracted position with an upright orientation. The identification of the position of the slats 3 in the upright position is provided by the contact sensors 51.

Preferably, the control device has several preset use modes each corresponding to a type of positioning of the slats. Thus, provision can be made for presetting a mode of total coverage of the surface 2 or a partial coverage mode. Similarly, provision can be made for presetting the orientation of the slats either in the upright position or in the closing position, or in an intermediate position.

To cover the surface 2, the slats 3 are successively brought out of their retracted position after a predetermined increment of movement and until the slats are occupying their desired extension position. Advantageously, the increment of movement of the slats corresponds to the separation between two consecutive contiguous slats in the horizontal position.

Thus, the movement motors 12 of the first slat 3 are controlled to provide the translation along the direction F of the carriages $\mathbf{10}_1$ and $\mathbf{10}_2$ of this first slat 3. When this first slat 3 has been moved by a given increment, the movement motors 12 of the second slat are controlled to provide the translation along the direction F of the carriages $\mathbf{10}_1$ and $\mathbf{10}_2$ of this second slat 3.

The control device thus controls the movement motors 12 associated with the slats 3 that must be deployed. The control device stops the operation of the movement motors 12 when the slats 3 are occupying their desired deployed position. The stopping of the operation of the movement motors 12 is provided either directly by the user according to his or her choice of unfolding of the slats or following a preset program planning the position of the slats 3 in definite positions ensured by the captors for measuring the rotation of the movement motors 12.

When the deployed slats 3 are occupying a fixed position, the control device can control the opening motors 14 to orientate the slats 3.

It should be noted that the control device controls the operation of the orientation motors 14 only if the slats 3 are occupying a fixed position that differs from the retracted position.

For the retraction of the slats 3, the control device controls the orientation motors 14 of the deployed slats to position them in the upright position. When the deployed slats 3 are occupying their upright position, the control device simultaneously controls the movement motors 12 of these slats to bring them successively to their retracted position detected by the position sensors 51.

The control device can thus selectively pilot the slat movement 12 and orientation 14 motors to cover all or part of the surface 2, with slats in the upright, closed or intermediate position. It should be noted that the slats 3 are translated solely in the upright position.

The invention is not limited to the examples described and shown as various modifications can be made thereto without departing from its scope.

The invention claimed is:

1. A unit for covering and uncovering a surface (2) delimited by a bearing structure (5) using adjustable slats (3), the unit comprising:

a series of adjustable slats, each adjustable slat having longitudinal edges and end edges, the series of adjustable slats extending mutually parallel along longitudinal edges thereof, each adjustable slat equipped with a pivot pin (4) at each end edge thereof;

an orientation system (I) for orientating the adjustable slats (3) suitable for pivoting at least some of the adjustable slats so that the longitudinal edges of the adjustable slats are contiguous or non-contiguous to respectively close or open the surface (2);

a movement system (II) for moving the adjustable slats (3) between a retracted position wherein the adjustable slats are side-by-side and a deployed position wherein at least a part of the adjustable slats are deployed with regard to the surface;

two guide tracks (8) for guiding the adjustable slats in translation, formed on the bearing structure (5) while being arranged mutually parallel along two opposite sides of the surface;

each adjustable slat (3) is supported by the pivot pins (4) using a set of two carriages guided in translation along the guide tracks (8);

the orientation system (I) comprises, for each carriage of the set of two carriages, at least one orientation motor (14) being mounted in at least one of the set of two carriages and angularly linked with the pivot pin;

position and adjustable slat (3) movement sensors (50);

characterized in that the movement system (II) comprises, two movement motors (12), one movement motor being mounted in a first carriage of the set of two carriages, and the other movement motor being mounted in a second carriage of the set of two carriages, each movement motor rotationally driving a pinion (17) engaging with a rack (18) assembled on the bearing structure along a direction parallel to the guide track, each pinion (17) of each movement motor engaging with the pivot pin (4) of each one of the series of adjustable slats for driving the pivot pin (4) of the one adjustable slat (3) in translation;

and a control device linked to the sensors (50), the movement motors (12) and the at least one orientation motor (14) for moving at least part of the adjustable slats in translation and orientating said adjustable slats.

2. The unit according to claim 1, wherein for the orientation system (I), the orientation motor (14) is mounted in the second carriage ($\mathbf{10}_2$).

3. The unit according to claim 2, characterized in that each of the second carriages ($\mathbf{10}_2$) provided with a movement motor (12) and an orientation motor (14), and each of the first carriages ($\mathbf{10}_1$) provided with a movement motor (12), are assembled alternately from one adjustable slat to the next adjustable slat, along each side of the surface to be covered or uncovered.

4. The unit according to claim 1, characterized in that each first carriage ($\mathbf{10}_1$) having the movement motor (12) has a main support body (15) for the movement motor, the main support body being provided with a rotational guide system (31) for the pivot pin (4) of each one of the adjustable slats, freely engaged in a housing (32) formed in each one of the adjustable slats, the pivot pin (4) being provided with the pinion (17) and rotationally driven by the movement motor (12).

5. The unit according to claim 4, characterized in that each carriage ($\mathbf{10}_1$, $\mathbf{10}_2$) comprises a main body linked by a removable link pin (20) to a guide bearing (11) engaging with a guide track (8).

6. The unit according to claim 1, characterized in that each second carriage ($\mathbf{10}_2$) having the movement motor (12) and the orientation motor (14) comprises a main support body (15) for the movement motor and the orientation motor, the main body (15) being provided with a system (41) for rotationally guiding a tubular shaft (42) having the pinion (17) and rotationally driven by the movement motor, the pivot pin (4) being assembled inside the tubular shaft (42) while being rotationally driven by the orientation motor (14) and assembled to rotate with one of the adjustable slats as a single part.

7. The unit according to claim 1, characterized in that each rack (18) is formed by a toothed belt attached to the bearing structure (5).

8. The unit according to claim 1, characterized in that the position and slat movement sensors (50) comprise contact sensors (51) assembled on each of the set of two carriages, the contact sensors (51) to be actuated by one of the carriages located ahead in a direction of extension of the adjustable slats or by the bearing structure for the carriage of the last adjustable slat in the direction of extension.

9. The unit according to claim 1, characterized in that the position and slat (3) movement sensors (50) comprise sensors for measuring a rotation of the movement motors and a rotation of the orientation motors as well as sensors for detecting a direction of orientation of the adjustable slats.

10. The unit according to claim 1, characterized in that the control device comprises a calibration mode and several preset use modes, each corresponding to a type of adjustable slat position.

11. The unit according to claim 1, characterized in that the control device controls the operation of the movement (12) and orientation (14) motors in such a way that prior to movement of an adjustable slat using the control device, the control device controls the orientation motor of said adjustable slat to place it in a vertical position if the adjustable slat is not occupying said vertical position.

12. The unit according to claim 1, characterized in that for a use mode consisting in an extension of a determined number of adjustable slats from the retracted position, the control device controls the operation of the movement motors (12) of the adjustable slats to be deployed, in such a way that each time a first adjustable slat is advanced by one increment, a second adjustable slat located upstream to the first adjustable slat is controlled to move, the movement motors (12) being controlled until the adjustable slats are in the deployed position.

13. The unit according to claim 12, characterized in that the control device controls the movement motors (12) in such a way that the increment of movement of the adjustable slats corresponds to separation between two consecutive slats contiguous in a horizontal position.

14. The unit according to claim 1, characterized in that the control device controls the operation of the orientation motors (14) only if at least one of the adjustable slats is occupying a fixed position different from the retracted position.

* * * * *